US005944219A

United States Patent [19]

Emoff et al.

[11] Patent Number: 5,944,219

[45] **Date of Patent: *Aug. 31, 1999**

[54] POINT-OF-PURCHASE COUPON DISPENSER

[76] Inventors: Michael J. Emoff, 5450 Sherfield Dr., Trotwood, Ohio 45426; Mary Jayne Miller, 539 Cottingwood Ct., Kettering, Ohio 45429

[ * ] Notice: This patent issued on a continued prosecution application filed under 37 CFR 1.53(d), and is subject to the twenty year patent term provisions of 35 U.S.C. 154(a)(2).

[21] Appl. No.: 08/652,031

[22] Filed: May 21, 1996

Related U.S. Application Data

[60] Provisional application No. 60/008,045, Oct. 30, 1995, and provisional application No. 60/006,749, Nov. 15, 1995.

[51] Int. Cl.[6] ..... A47K 10/24

[52] U.S. Cl. ..... 221/45; 221/63

[58] Field of Search ..... 221/45, 33, 63, 221/52, 185; 312/61; 428/43, 42.1, 354, 401

[56] References Cited

U.S. PATENT DOCUMENTS

| | | | |
|---|---|---|---|
| 1,678,339 | 7/1928 | Horwitt | 221/35 |
| 2,098,477 | 11/1937 | Welsh | 221/45 |
| 2,256,204 | 9/1941 | Jameson | 221/45 |
| 3,068,055 | 12/1962 | Lenzi et al. | 312/50 |
| 4,562,938 | 1/1986 | Loder | 221/46 |
| 4,623,073 | 11/1986 | Hansen | 221/45 |
| 4,770,320 | 9/1988 | Miles et al. | 221/33 |
| 4,805,331 | 2/1989 | Boggess et al. | 40/651 |
| 4,842,303 | 6/1989 | Molenda | 281/38 |

(List continued on next page.)

FOREIGN PATENT DOCUMENTS 186224 9/1936 Switzerland .

OTHER PUBLICATIONS

Packet of (4) four photographs showing prior art dispenser.
Advertisement published by Allegro Electronics Corporation, Fremont, CA, admitted to be prior art.
Advertisement published by Ozen Sound Devices, Inc., New York, N.Y., admitted to be prior art.

(List continued on next page.)

*Primary Examiner*—Kenneth Noland
*Attorney, Agent, or Firm*—Roger S. Dybvig

[57] ABSTRACT

A pop-up coupon dispenser for small sheets which have a repositionable adhesive is provided with a flexible plastic cable tie. The dispenser includes a box filled with such sheets having an adhesive stripe along one margin and stacked in accordion fashion, the sheets being printed as manufacturer's coupons supplied to a retailer who attaches the box by the cable tie to a wire rack, to a cardboard display or other suitable support, such as a shelf, and cuts off the excess end of the cable tie. Customers can remove the coupons one-at-a-time and affix them by their adhesive backing to the product for which the coupon is redeemable. A check-out cashier can, therefore, immediately determine that the purchaser is purchasing the product for which the coupon was issued. The dispenser box may also be provided with a conventional shelf clip connected to the bottom of the dispenser box. Each coupon could comprise an unperforated sheet but could have a tear line adjacent the margin of the adhesive so that, in use, the customer can adhere the adhesively-coated portion of the coupon to the product to which the coupon applies. At the check-out counter, the cashier tears away the remainder of the label along the tear line. The torn-away portion, which is used by the retailer to redeem the coupon, will be easy for the check-out cashier and others to accumulate and handle. Also, the face of the sheet opposite the adhesively-coated portion may have advertising matter which the customer would take, because adhered to the purchased product, when leaving the retail store. In addition, a blinking LED could be housed within the dispenser box in alignment with an opening in the wall of the box to bring added attention to the dispenser box.

40 Claims, 14 Drawing Sheets

U.S. PATENT DOCUMENTS

| | | | |
|---|---|---|---|
| 4,951,837 | 8/1990 | Lentsch | 221/45 |
| 4,953,746 | 9/1990 | Andriash | 221/35 |
| 4,986,440 | 1/1991 | Windorski | 221/45 |
| 5,083,765 | 1/1992 | Kringel | 271/118 |
| 5,097,981 | 3/1992 | Degasperi et al. | 221/3 |
| 5,366,776 | 11/1994 | Mertens | 428/40 |
| 5,401,547 | 3/1995 | Blackwell et al. | 428/40 |
| 5,439,721 | 8/1995 | Pedroli et al. | 428/42.1 |
| 5,470,138 | 11/1995 | Kump | 312/34.4 |

OTHER PUBLICATIONS

See accompanying Information Disclosure Statement regarding admitted prior art coupon pads formed from self–adhestive note papers.

See accompanying Information Disclosure Statement regarding admitted prior art dispense for self–adhesive note papers.

POINT-OF-PURCHASE COUPON DISPENSER

CROSS-REFERENCE TO RELATED APPLICATIONS

This application is a continuation-in-part of provisional patent application Ser. No. 60/008,045, filed Oct. 30, 1995, and a continuation-in-part of provisional patent application Ser. No. 60/006,749, filed Nov. 15, 1995.

FIELD OF THE INVENTION

This invention relates to coupon dispensers such as used by suppliers to grocery store retailers for promoting their goods. More particularly, this invention is directed to coupon dispensers intended to be located close to the goods for which the coupons are distributed—typically on the same shelf or display stand as the goods—and therefore referred to as "point-of-purchase" dispensers.

BACKGROUND OF THE INVENTION

There are primarily two types of point-of-purchase coupon dispensers, namely, coupon pads and refillable dispensers. A stack of loose coupons may also be placed on a store shelf or on a counter. Loose coupons and coupon pads are inexpensive but can be inefficient because customers often take several coupons at a time and throw away all but one, which is destructive of coupon marketing programs. Loose stacks of coupons can become messy and coupon pads are often unattractive, especially after prolonged use. Reusable coupon dispensers are constructed to discourage customers from taking a large number of coupons at a time. However, reusable dispensers are costly and require surveillance by retail store personnel to determine if they need to be refilled or require maintenance. They are also time-consuming because someone reasonably skilled must take time to refill them.

Coupons are often turned in at a check-out counter to enable the purchaser to obtain a reduced price for the goods. This can create the familiar problem that the check-out cashier has to take time to verify that the goods for which the coupon is issued are, in fact, being purchased by the customer who presents the coupon. Many customers must rummage among a stack of coupons to find a particular coupon to be used. All of this activity can be a source of delay and irritation for check-out cashiers and for those waiting in a check-out line during the coupon redemption processes.

SUMMARY OF THE INVENTION

An object of this invention is to provide an attractive, inexpensive coupon dispenser which does not require refilling or maintenance, as with more expensive reusable dispensers, is easy to use, and will discourage customers from taking a handful of loose or padded coupons. Another object of this invention is to provide a coupon dispensing system by which customers need not search for coupons for goods purchased and by which check-out cashiers can immediately determine that the product to which a coupon applies is being purchased.

A coupon dispenser in accordance with this invention comprises a pop-up dispenser box that houses a stack of small sheets which have a lightly aggressive, repositionable adhesive. The dispenser box is provided with a flexible plastic cable tie for mounting the dispenser box on a wire rack, retail store shelf, or a cardboard display. The POP N JOT dispensers for 3M's POST-IT note sheets marketed by 3M Company of St. Paul, Minn. are good for this use, the POST-IT sheets being printed as coupons. The dispenser box is provided with a plastic stiffening plate, which may be injection molded but could be die cut from a sheet of plastic, and the plastic cable tie extends through pairs of aligned holes in the bottom of the box and the stiffening plate. The stiffening plate is secured, at least in part, against the inside bottom of the box by the cable tie but a suitable adhesive may be used instead.

In use, a box which has been prefilled with POST-IT sheets printed as manufacturer's coupons is supplied to a retailer who attaches the box by the cable tie to a wire rack, a retail store shelf, a cardboard display or other suitable support, and cuts off the excess end of the cable tie. Customers can remove the coupons one-at-a-time and affix them by their adhesive backing to the product for which the coupon is redeemable. A check-out cashier can, therefore, immediately determine that the purchaser is purchasing the product for which the coupon was issued. When the dispenser box is emptied, the retailer can simply remove it by cutting the cable tie and dispose of the box and the attached cable. The dispenser box can readily be replaced by another dispenser box of the same construction.

In a first modification, a dispenser box with a plastic stiffening plate, as described above, which may optionally be provided with a cable tie as described above, is provided with a conventional plastic or other shelf clip connected by rivets (not shown) or by other means, such as screws or glue, to the bottom of the dispenser box.

In another modification, the coupons have a tear line adjacent the margin of the adhesive so that, in use, the customer can adhere the adhesively-coated portion of the coupon to the product to which the coupon applies. At the check-out counter, the cashier tears away the remainder of the label along the tear line. The torn-away portion, which is used by the retailer to redeem the coupon, will be easy for the check-out cashier and others to accumulate and handle. Also, the face of the sheet opposite the adhesively-coated portion may have advertising matter which the customer would take, because adhered to the purchased product, when leaving the retail store.

In any one or all of the above embodiments, a blinking LED could be housed within the dispenser box in alignment with an opening in the wall of the box to bring added attention to the dispenser box.

Other objects and advantages will become apparent from the following description and claims and from the accompanying drawings.

BRIEF DESCRIPTION OF THE DRAWINGS

FIG. 8 also shows a combined stiffening plate and template used to enhance the mounting of the coupon dispenser on the display panel.

DETAILED DESCRIPTION

Figure 1:
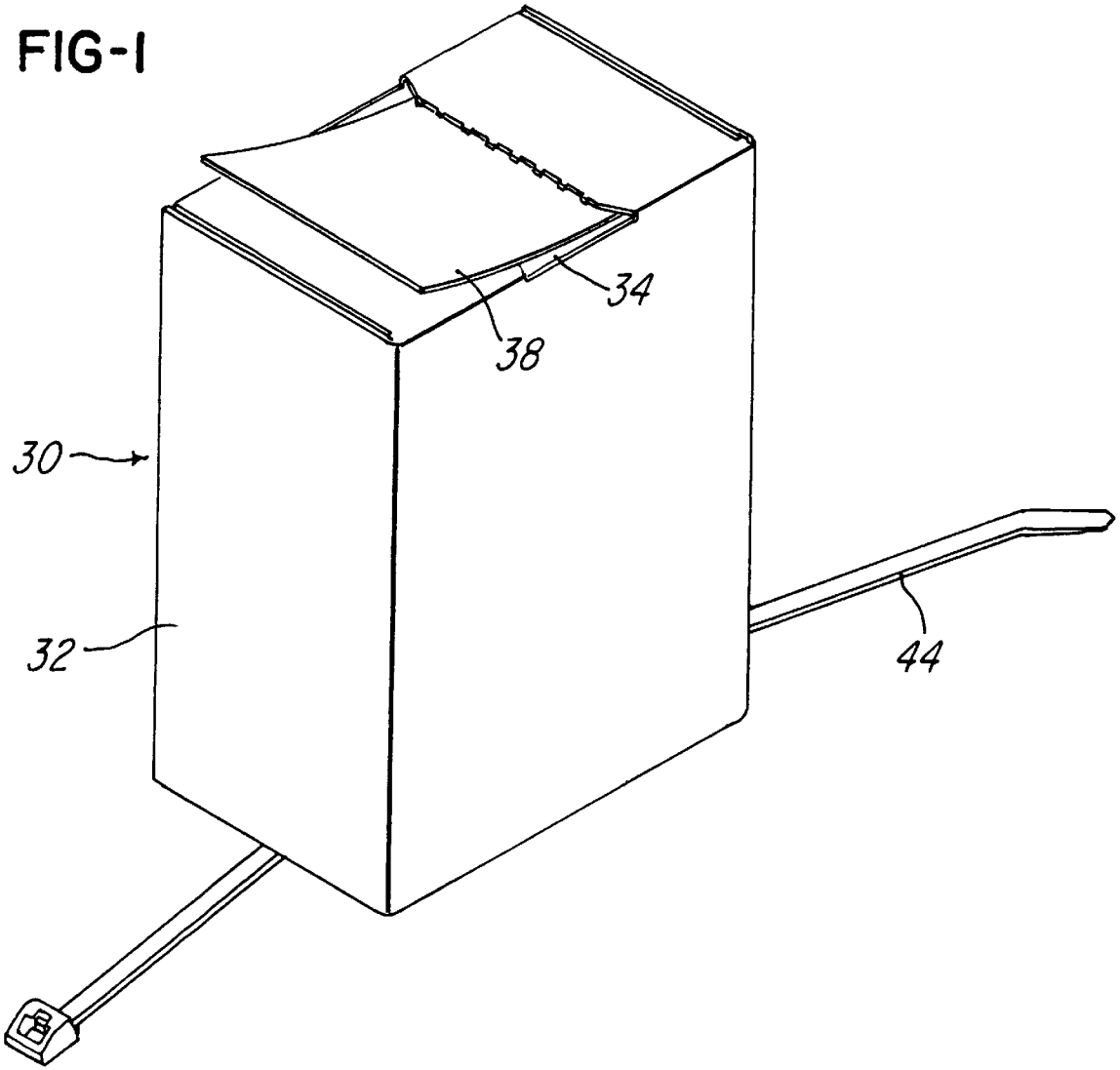
FIG. 1 is a perspective view of a coupon dispenser in accordance with this invention open in preparation for use showing the front, the top and one side of the dispenser.
Figure 2:
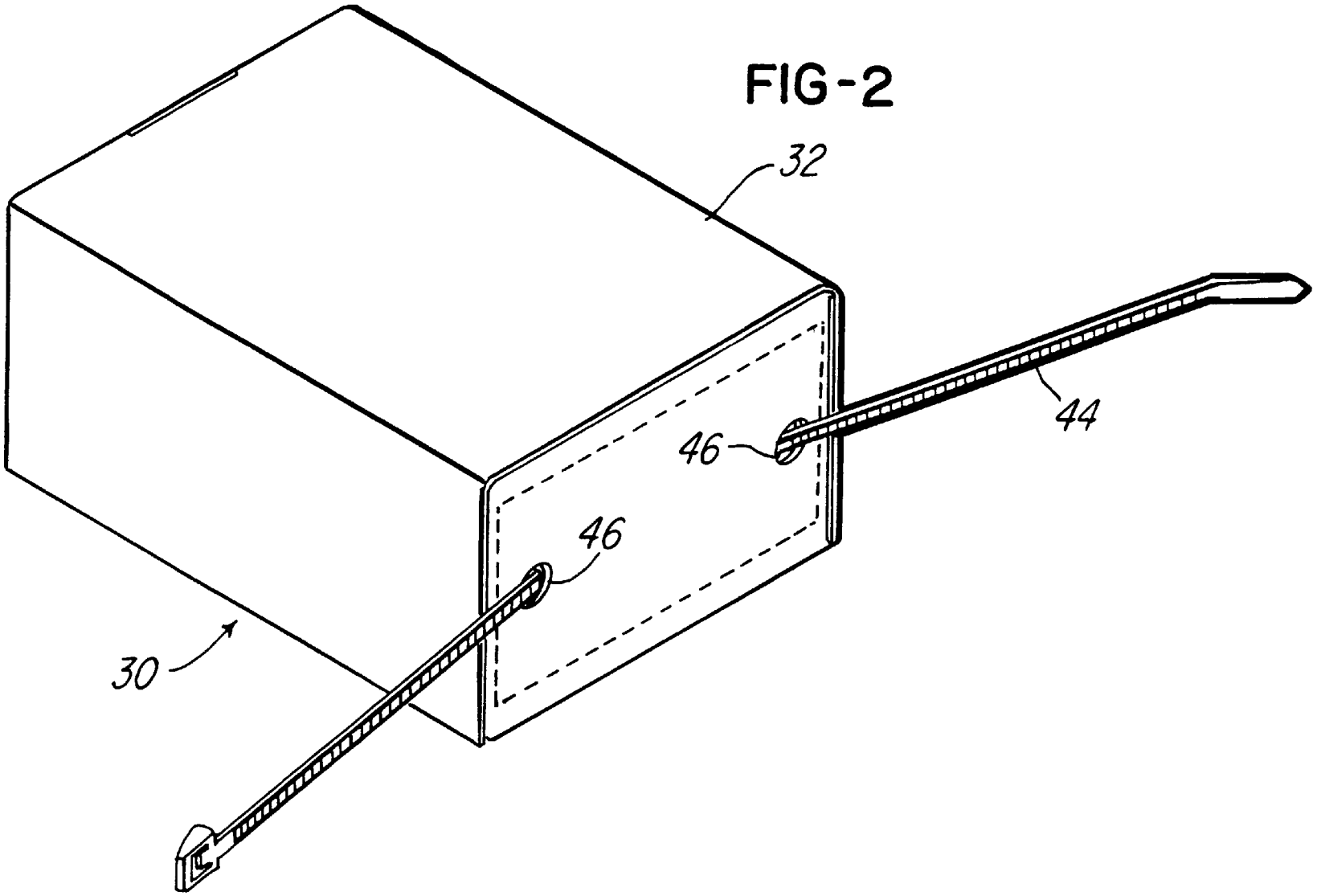
FIG. 2 is a perspective view of the coupon dispenser of FIG. 1 showing the front, the bottom and the same side as FIG. 1.
Figure 3:
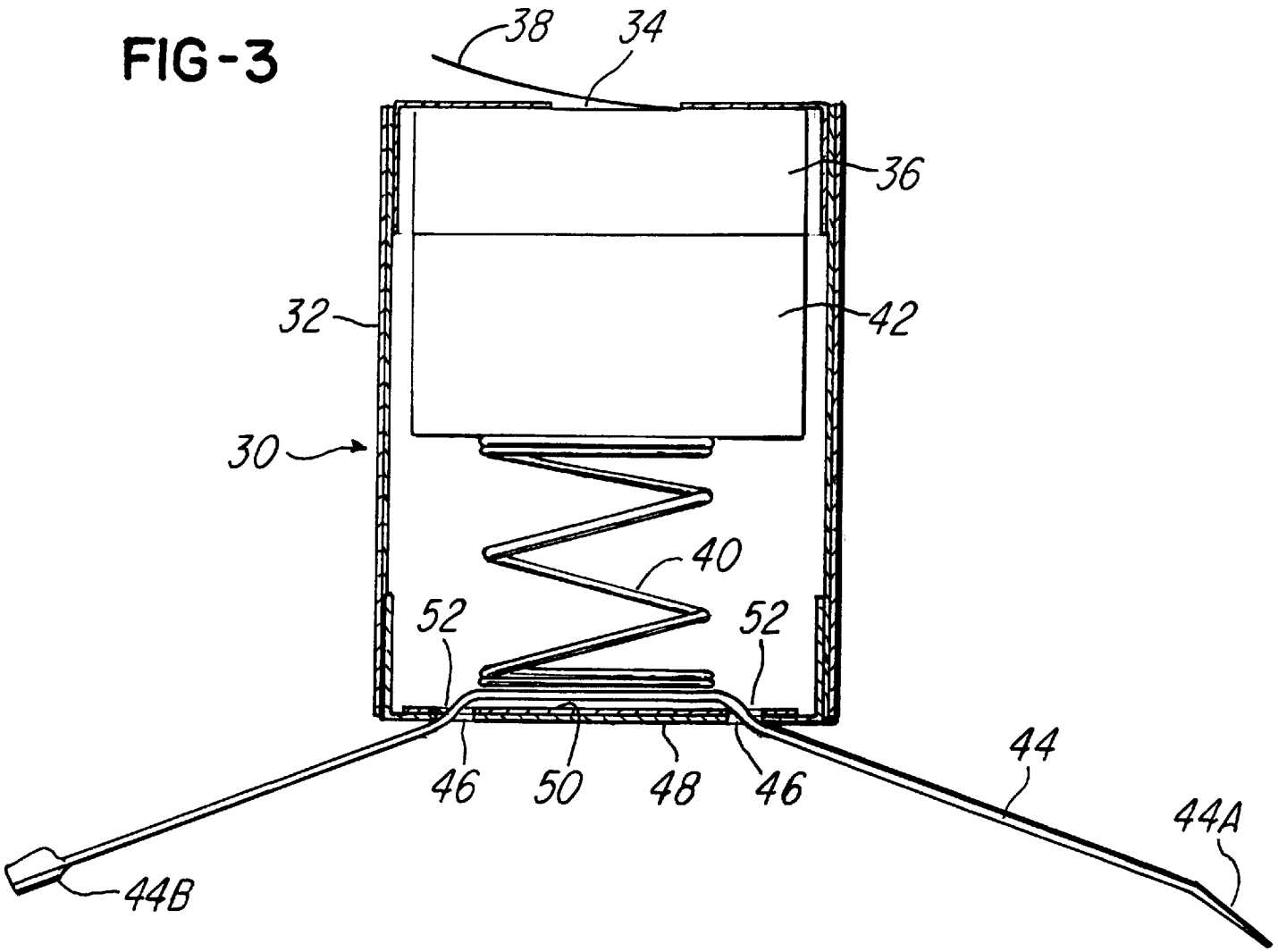
FIG. 3 is a cross-sectional view of the coupon dispenser of FIG. 1 but showing parts of the coupon dispenser other than the dispenser box in elevation.

With reference to FIGS. 1, 2 and 3, a coupon dispenser, generally designated 30, in accordance with this invention comprises a dispenser box 32, the top of which has a central, transversely-extending opening 34 formed by tearing away a tear-away portion (not shown). A stack 36 of sheets 38, each of which has a repositionable, pressure sensitive adhesive strip along one bottom margin thereof, is housed in the box 32. The sheets 38 preferably comprise those marketed under the trademark POST-IT by 3M Company of St. Paul, Minn., which have been printed to be usable as merchandise coupons. They be made from paper or other suitable material, such as a polymeric material as taught in U.S. Pat. No. 4,770,320, coated with a strip of repositionable adhesive. The sheets are preferably stacked in accordion fashion so that the adhesive strip on a sheet 38 being pulled from the top of the stack 36 pulls the next sheet 38 in the stack 36 partly outwardly through the box opening 34. As shown in FIG. 3, the stack 36 of sheets 38 is biased upwardly into engagement with the bottom surface of the top wall of the box 32 by means of a coil spring 40 and a pressure pad 42 confined with in the inside of the box 32. The spring 40 may be made from metal and the pressure pad 42 from a plastic foam material. 3M Company markets a dispenser box of accordion-stacked POST-IT notes with such a coil spring and a foam plastic pressure pad under the trademark POP N JOT. As will become apparent, POP N JOT dispensers can readily be modified to produce a coupon dispenser in accordance with this invention.

In accordance with this invention, a flexible plastic cable tie 44 is threaded through a pair of apertures 46 in the bottom wall, designated 48, of the box 32 such that the ends of the cable tie 44 are outside the box 32 and an intermediate portion of the cable tie 44 is located within the inside bottom of the box 32. The cable tie 44 is of the well-known type having a tail end 44A which can be inserted through a socket 44B at its opposite end, and has a plurality of closely-spaced ribs along its length which engage a tongue formed in the socket 44B. The ribs and the tongue are designed to permit the tail end 44A to be pulled through the socket 44B but prevent the withdrawal of the tail end 44A from the socket 44B. Cable ties suitable for this purpose are well known and readily available. In addition to being inexpensive and easy to use, cable ties of this type can readily be cut by an ordinary pair of scissors for removal.

Figure 7:
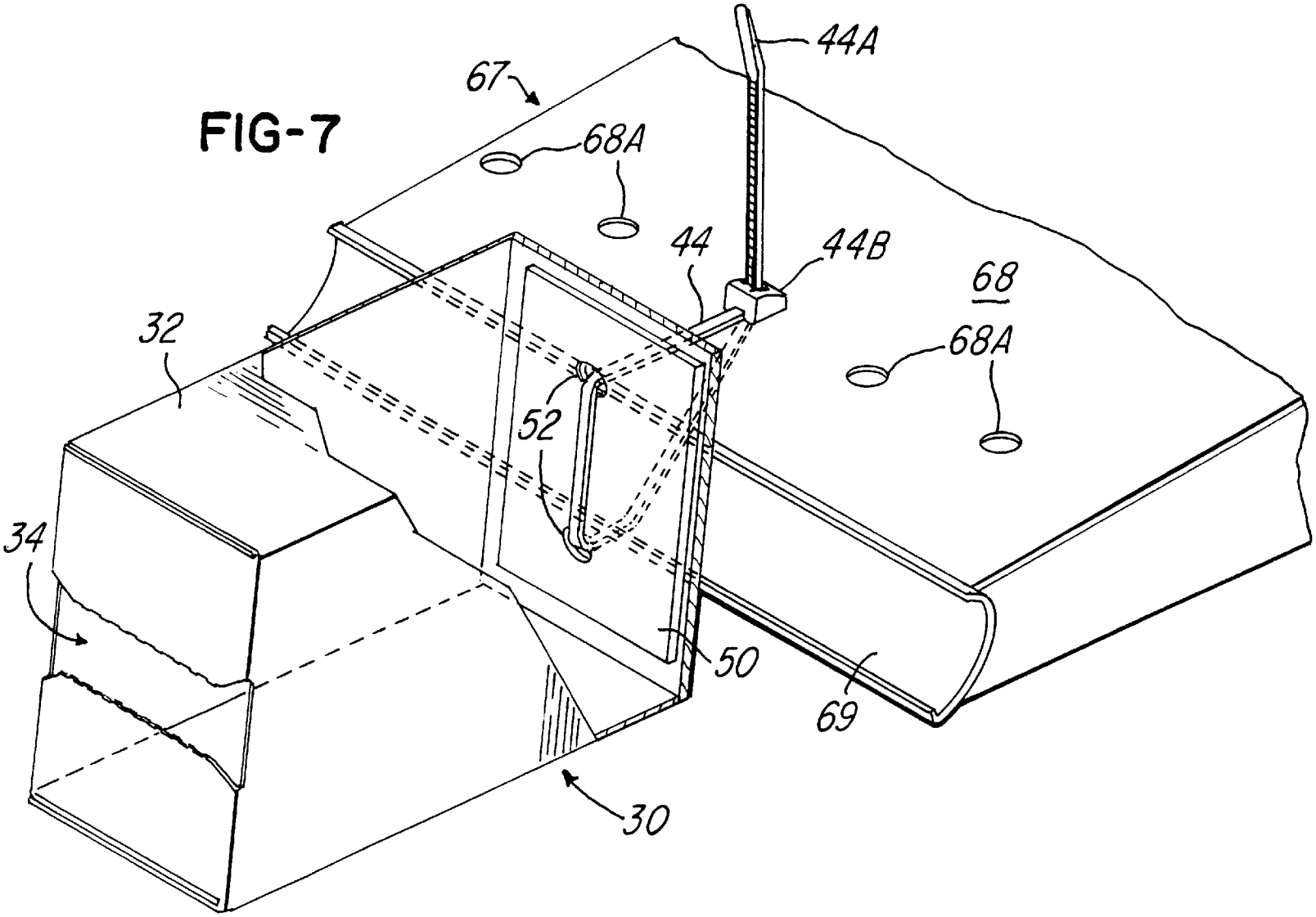
FIG. 7 is a perspective view of a sheet metal retail store shelf with the coupon dispenser of FIG. 1 mounted on the shelf. Parts of the coupon dispenser inside its box are omitted in FIG. 7 in order to show interior detail.

With reference to FIGS. 3 and 7, a thin, plastic stiffening plate 50 is held against the inside surface of the bottom wall 48 by the spring 40 and the cable tie 44, but could be attached to the bottom wall 48 by a suitable adhesive. The plate 50 may be injection molded but could be die cut from a sheet of plastic and has apertures 52 aligned with the bottom wall apertures 46. Accordingly, the cable tie 44 extends through both aligned pairs of apertures 46 and 52. It will be noted that the dispenser box 32 is in the form of a rectangular parallelepiped with its sides, top and bottom having longer edges and shorter edges. The spring 40 is round and has a diameter which is less than the length of the smaller edges of the box 32. In FIG. 3, the apertures 46 and 52 are shown spaced apart by a distance greater than the diameter of the spring 40 so that the bottom coil of the spring 40 bears against and presses down on the cable tie 44. The illustration of FIG. 3 is somewhat inaccurate in order to more clearly illustrate the parts. FIG. 3 is inaccurate in that it shows the horizontal stretch of the cable tie 44 inside the box 32 spaced throughout its length from the bottom wall 48 whereas in actuality the spring 40 presses that stretch of the cable tie 44 against the bottom wall. In other configurations, which are not illustrated, the spring 40 could have a diameter greater than the spacing between the pairs of apertures 46 and 52 in which cases the spring 40 would not engage the cable tie 44.

Figure 4:
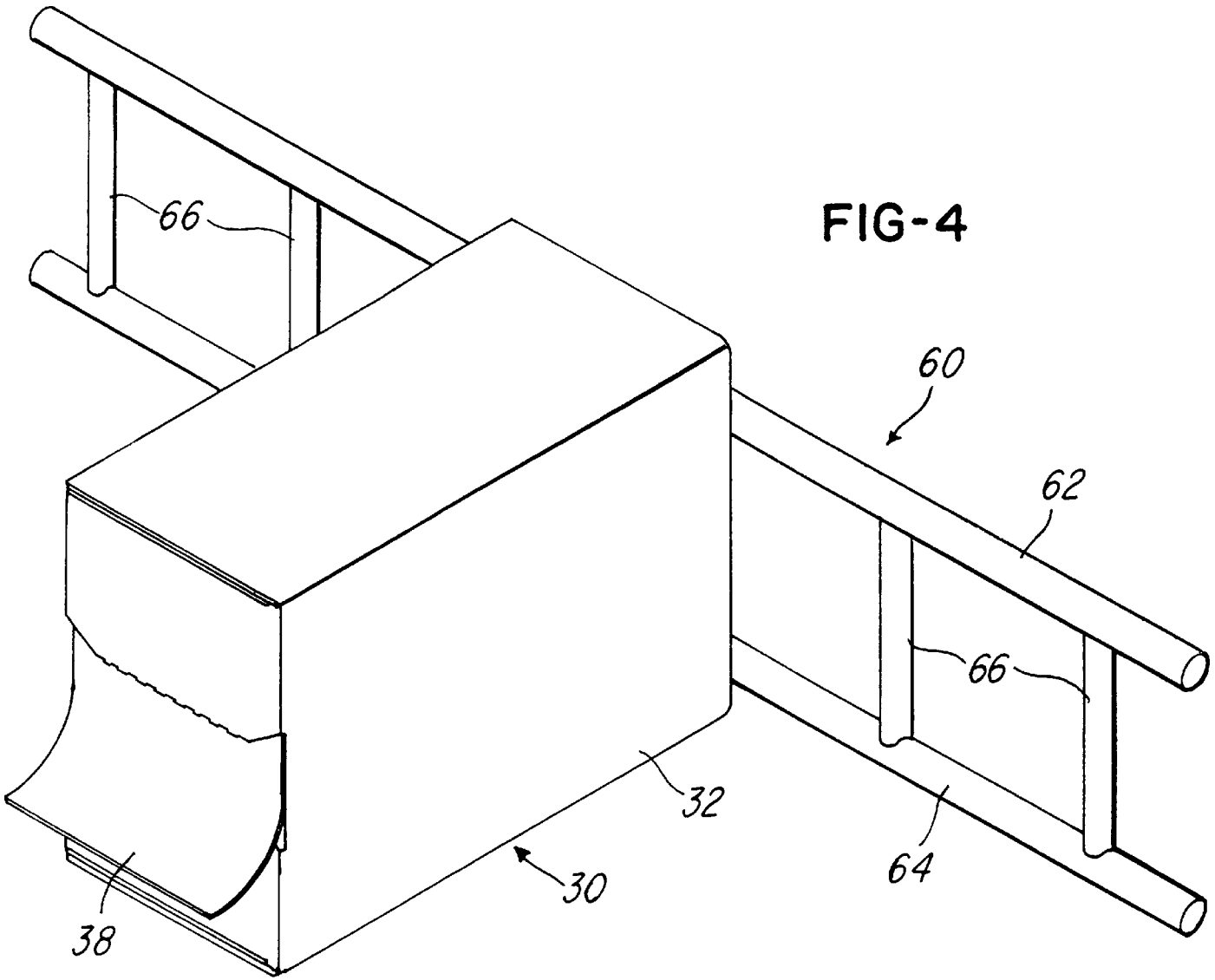
FIG. 4 is a perspective view of a wire shelving rack with the coupon dispenser of FIG. 1 mounted on the rack.
Figure 5:
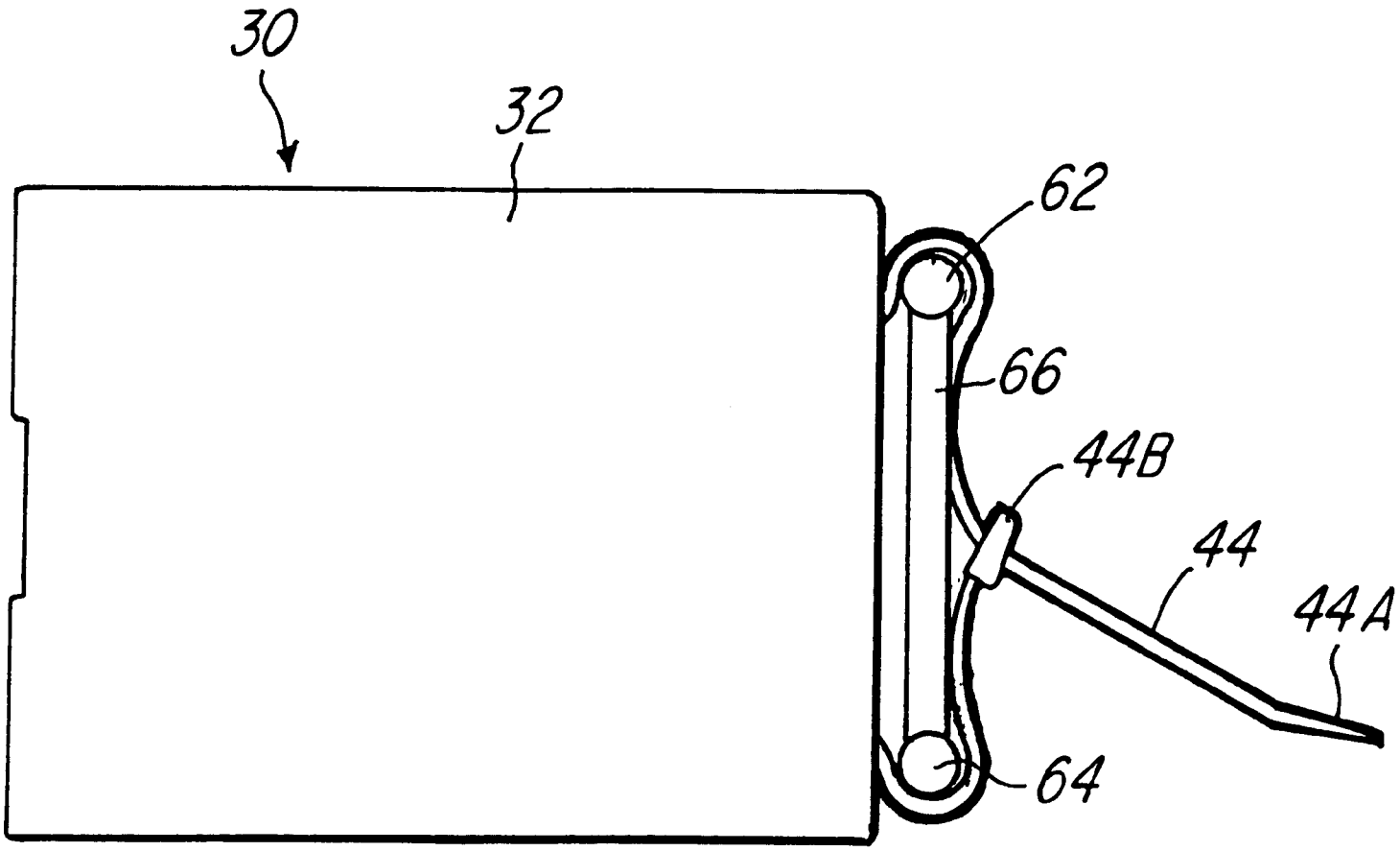
FIG. 5 is a side elevational view of the wire shelving rack and the mounted coupon dispenser of FIG. 4.
Figure 6:
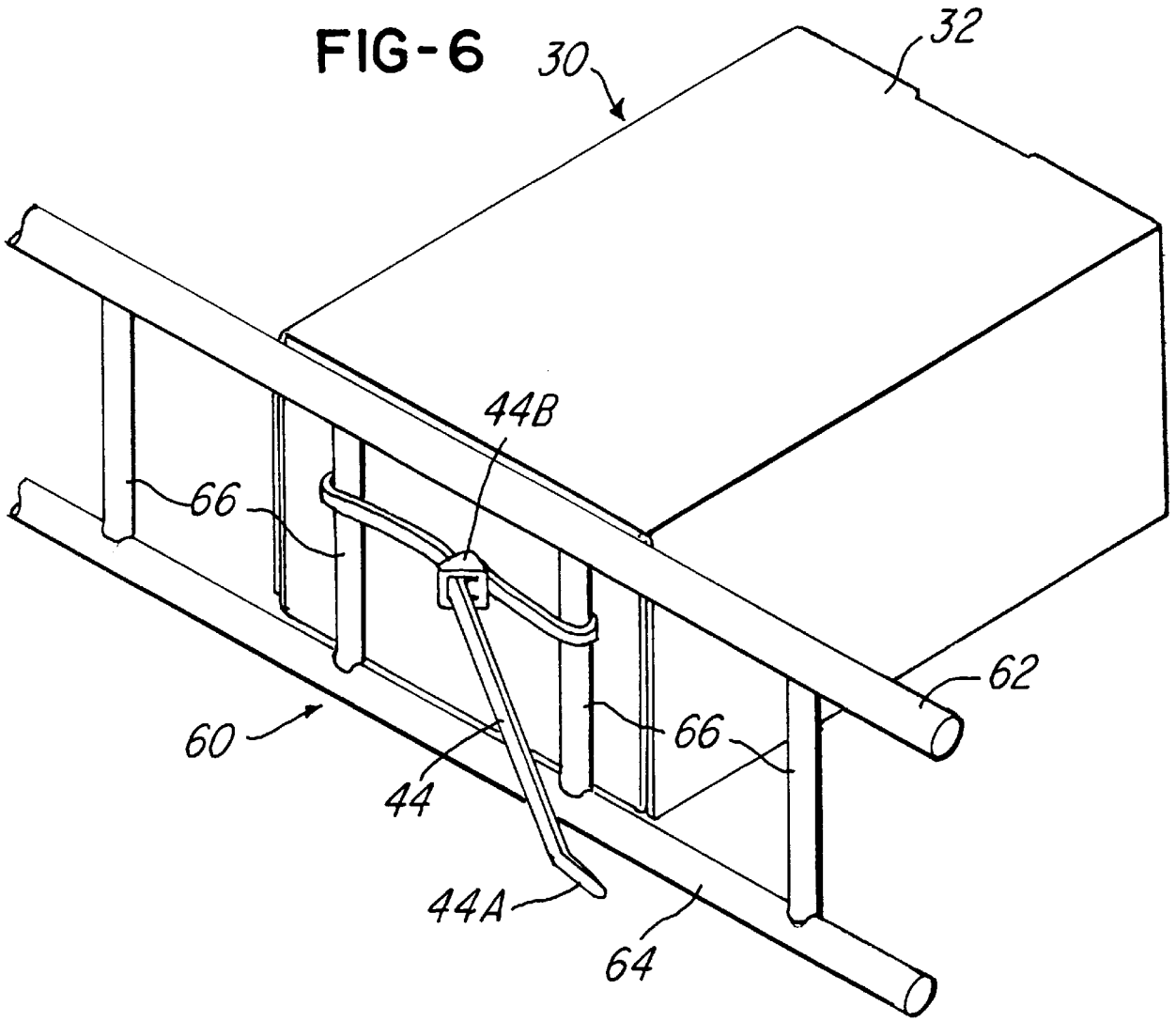
FIG. 6 is a perspective view from the rear of the shelving rack and showing a mode of mounting the coupon dispenser of FIG. 1 thereon different from that of FIGS. 4 and 5.

An advantage of the coupon dispensers of this invention is the ease with which they can be mounted on retail store shelving. FIGS. 4, 5 and 6 illustrate the mounting of the coupon dispenser 30 onto a metallic wire shelf rack 60 having horizontal cross bars 62 and 64 separated by several, mutually-spaced vertical struts 66. In FIGS. 4 and 5, the cable tie 44 is shown coursed around the cross bars 62 and 64 while in FIG. 6, the cable tie 44 is wrapped around a pair of struts 66.

FIG. 7 illustrates the mounting of the coupon dispenser 30 onto a grocery shelf, generally designated 67, having a metal shelf plate 68 with a row of apertures 68A parallel to its front edges and a depending pricing channel 69. In this arrangement, the tail end 44A of the cable tie 44 is extended around the bottom of the pricing channel 69 and upwardly through one of the shelf apertures 68A and then through the socket 44B. In this case, and in any other cases in which the tail end 44A of the cable tie 44 extends substantially past the socket 44B after assembly onto a shelf, rack or the like, the tail end portion of the cable tie protruding past the socket 44B can readily be removed by cutting it with a pair of scissors.

Figure 8:
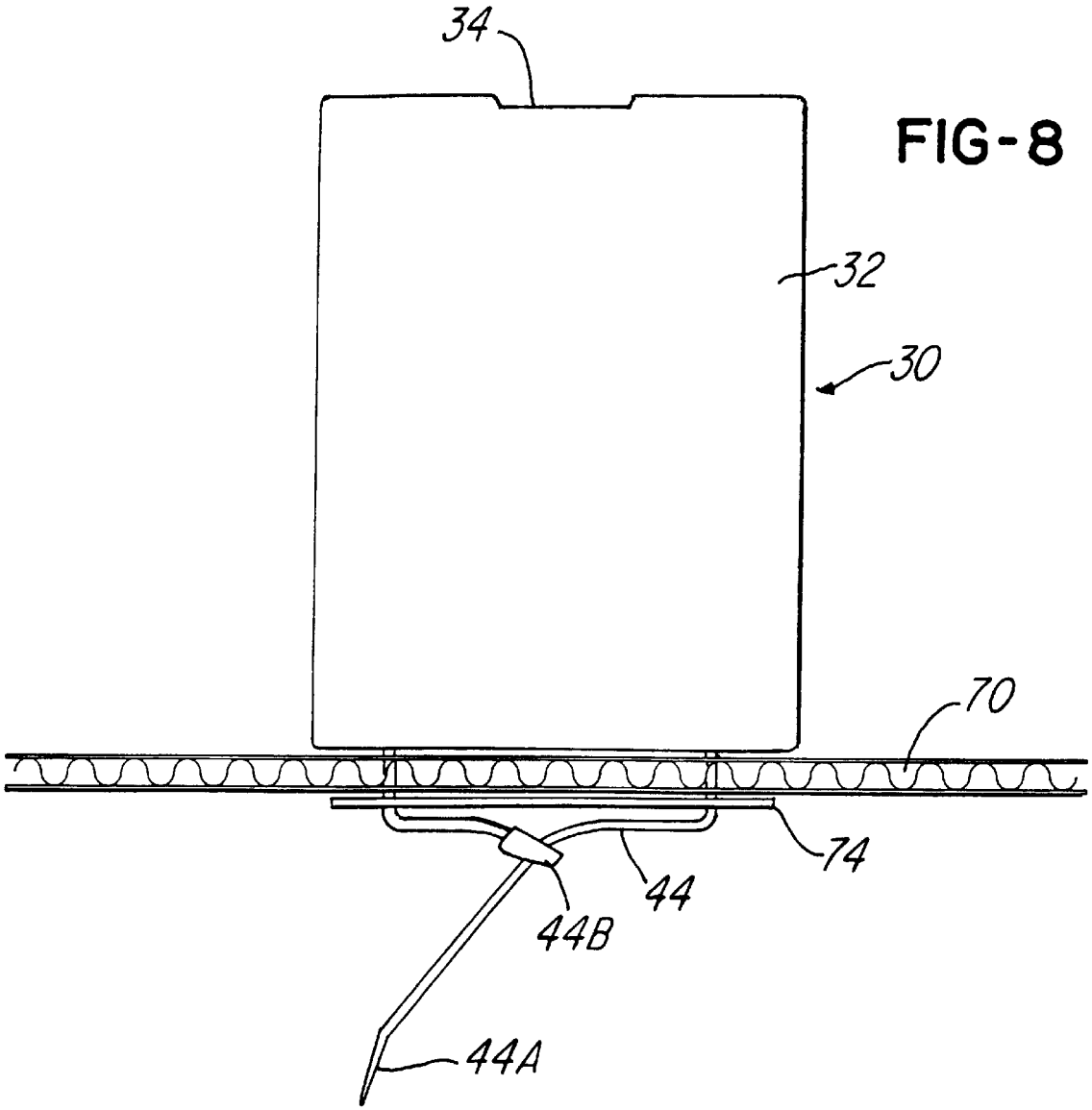
FIG. 8 is a front elevational view of the coupon dispenser of FIG. 1 shown mounted on a corrugated cardboard display panel, the panel being shown in cross-section.
Figure 9:
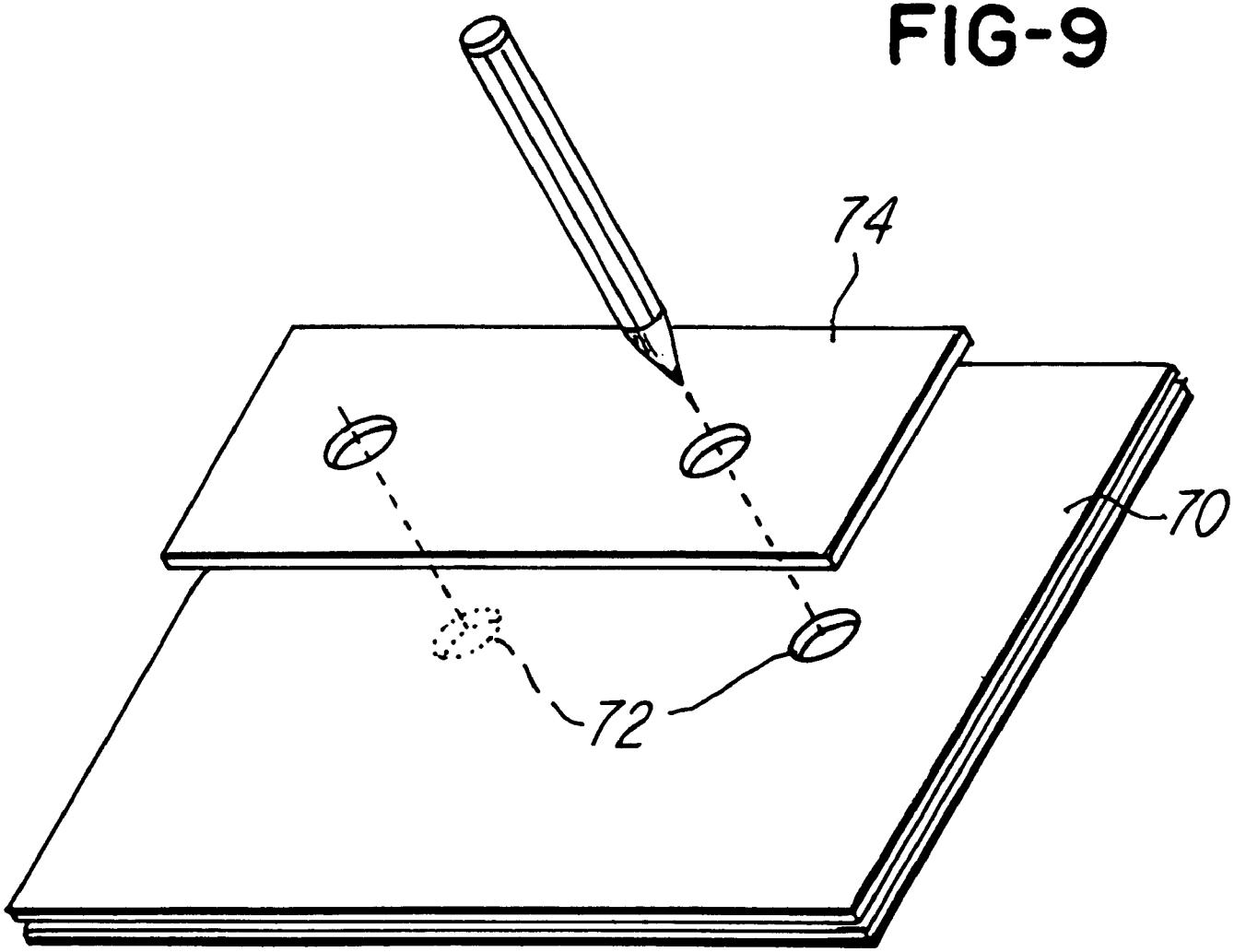
FIG. 9 is a perspective view of a cardboard display panel, the combined stiffening panel and a marking pencil, and diagrammatically illustrates how the combined stiffening plate and template is used as a template.

Referring to FIGS. 8 and 9, the dispenser 30 can be readily mounted on a corrugated cardboard display panel 70 merely by providing a pair of mutually spaced apertures 72 in the panel 70 through which the cable tie 44 is extended. A combined template and stiffening plate 74 is preferably provided to back up the display panel 70 and may be formed from plastic in a manner similar to that described above with regard to the stiffening plate 50 . The plate 74 has a pair of apertures spaced apart by substantially the same distance as the aligned pairs of holes 46 and 52 through which the cable tie 44 exits from the bottom of the display box 32. Accordingly, the display box 32 can be rigidly mounted to extend perpendicularly from the front face of the display panel 70. To clearly show all of the parts, the box 32 and the plate 74 are shown separated from the respective confronting faces of the display panel 70 in FIG. 8. In actuality, the cable tie 44 would normally be drawn sufficiently tight to clamp the box 32 and the plate 74 to the display panel 70. Use of the plate 74 as a template to locate and mark the display panel apertures 72 is diagrammatically illustrated in FIG. 9.

Figure 10:
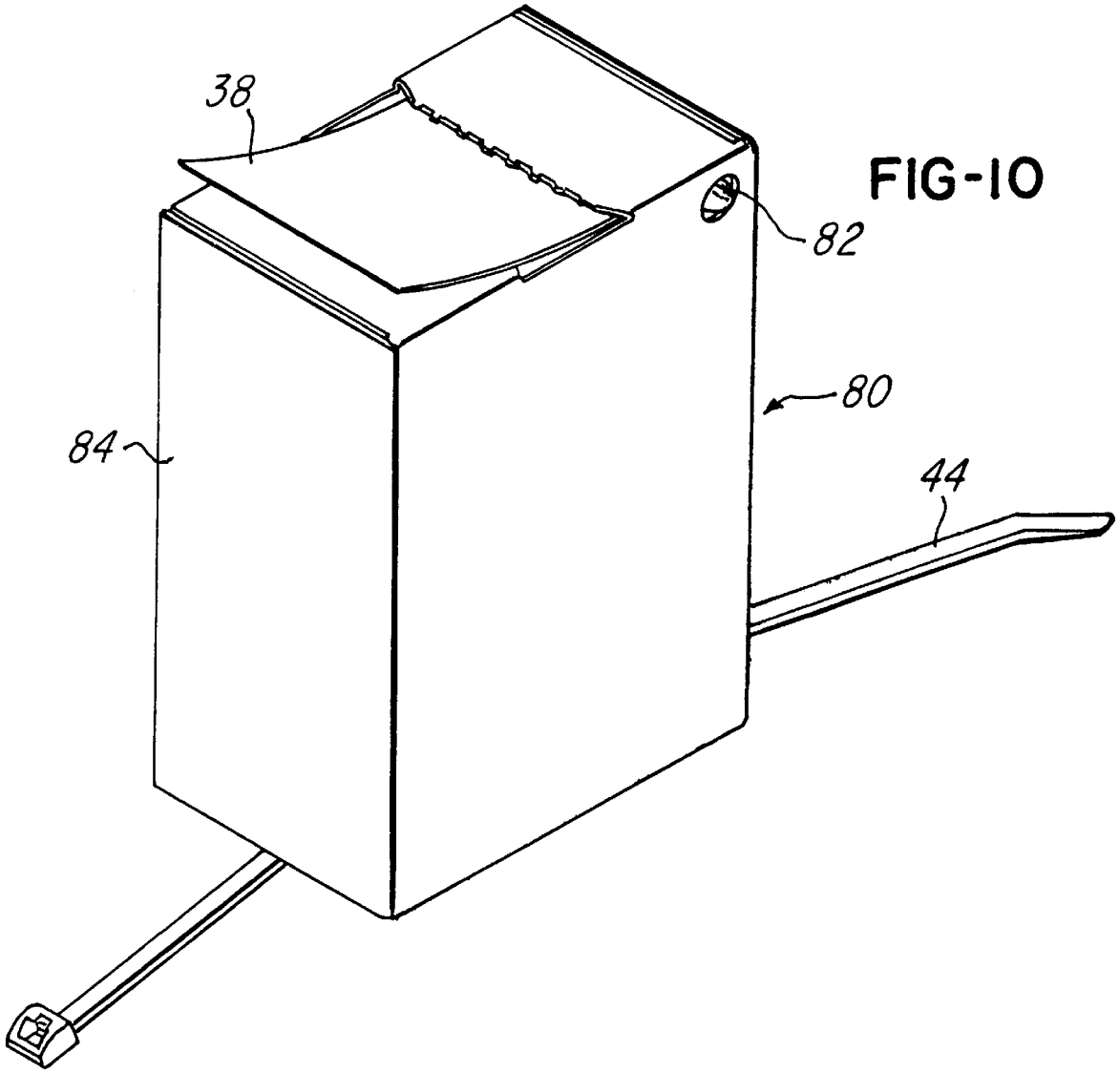
FIG. 10 is a perspective view similar to FIG. 1 but showing a second embodiment of a coupon dispenser in accordance with this invention.

A modified coupon dispenser 80 is illustrated in FIG. 10 which may be identical with the coupon dispenser 30 but additionally includes an LED 82 housed within its box 84. For attracting attention to the dispenser 80, the LED 82 can be caused to blink on and off by a circuit (not shown), including one or more batteries (not shown), housed within the dispenser box 84. Blinking LED displays usable with this invention are commercially available, such as those marketed by Allegro Electronics Corporation, Fremont, Calif. 94538. Operation of the blinking LED 82 can be started when the dispenser 80 is assembled or may be initiated by the retailer who installs the dispenser on a shelf or display panel by means of a suitable switch (not shown).

Figure 11:
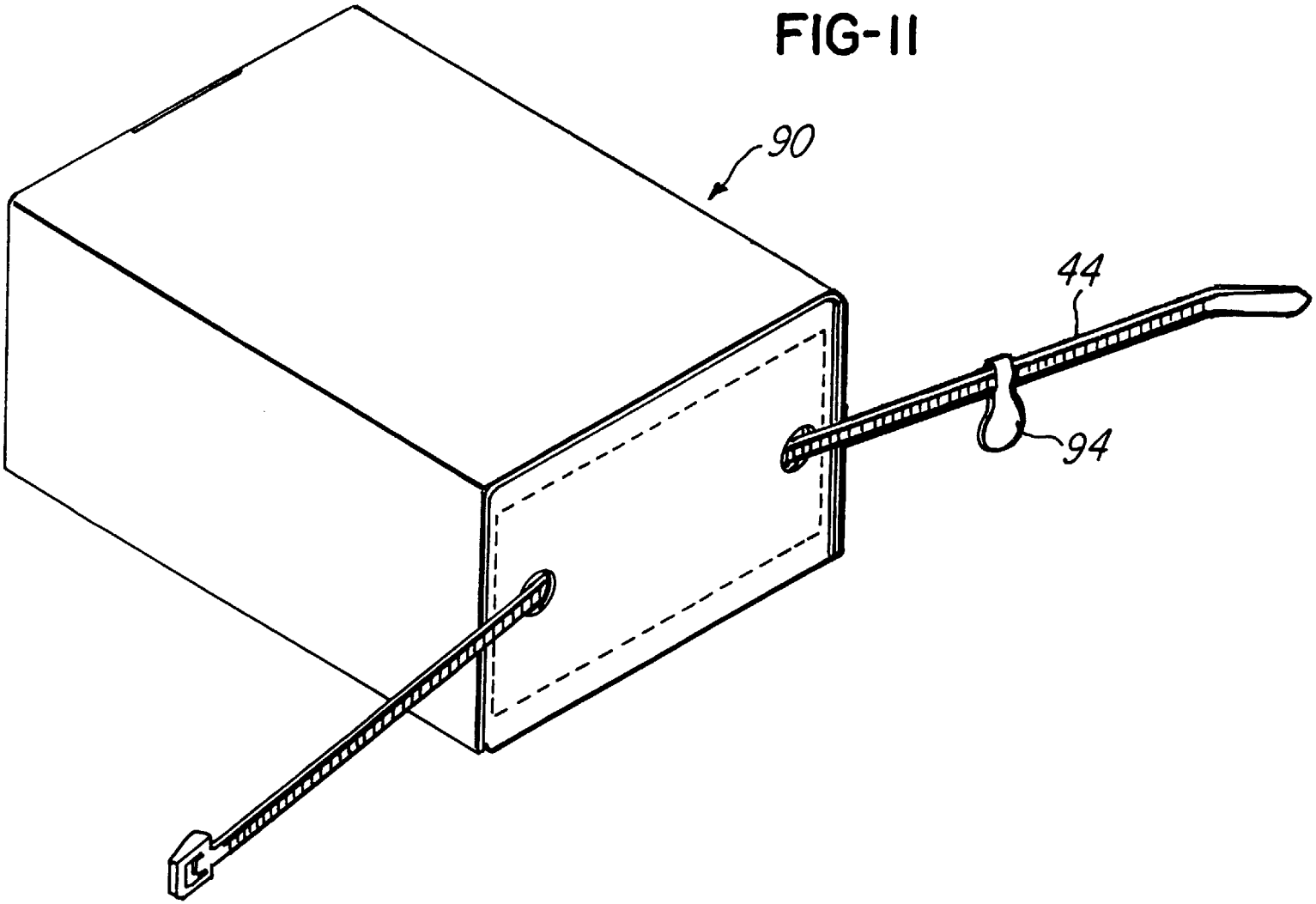
FIG. 11 is a perspective view similar to FIG. 2 but showing a third embodiment of a coupon dispenser in accordance with this invention.

In the embodiments of this invention described above, the cable tie 44 is reasonably securely held in the dispenser box during handling by means of the frictional engagement between cable tie 44 on the one hand and, on the other hand, the apertures in the box and the stiffening plate inside the box. The spring 40 may also clamp the middle portion of the cable tie 44 to internal stiffening plate 50. FIG. 11 shows an accessory designed for use with a dispenser box, designated 90, which has relatively large cable-exit apertures 92 and, accordingly, produces a relatively low frictional resistance to relative movements of the box 90 and the cable tie 44. A thin paper tab 94 is wrapped around the cable tie 44 to act as a stop to prevent the cable tie from accidentally sliding out of the dispenser box 90. Tab 94 has a coating of a pressure sensitive adhesive on its bottom surface which is used to hold the tab 94 assembled on the cable tie 44. When the box 90 is to be mounted for use in a store, the paper tab 94 is simply torn away from the cable tie 44.

Figure 12:
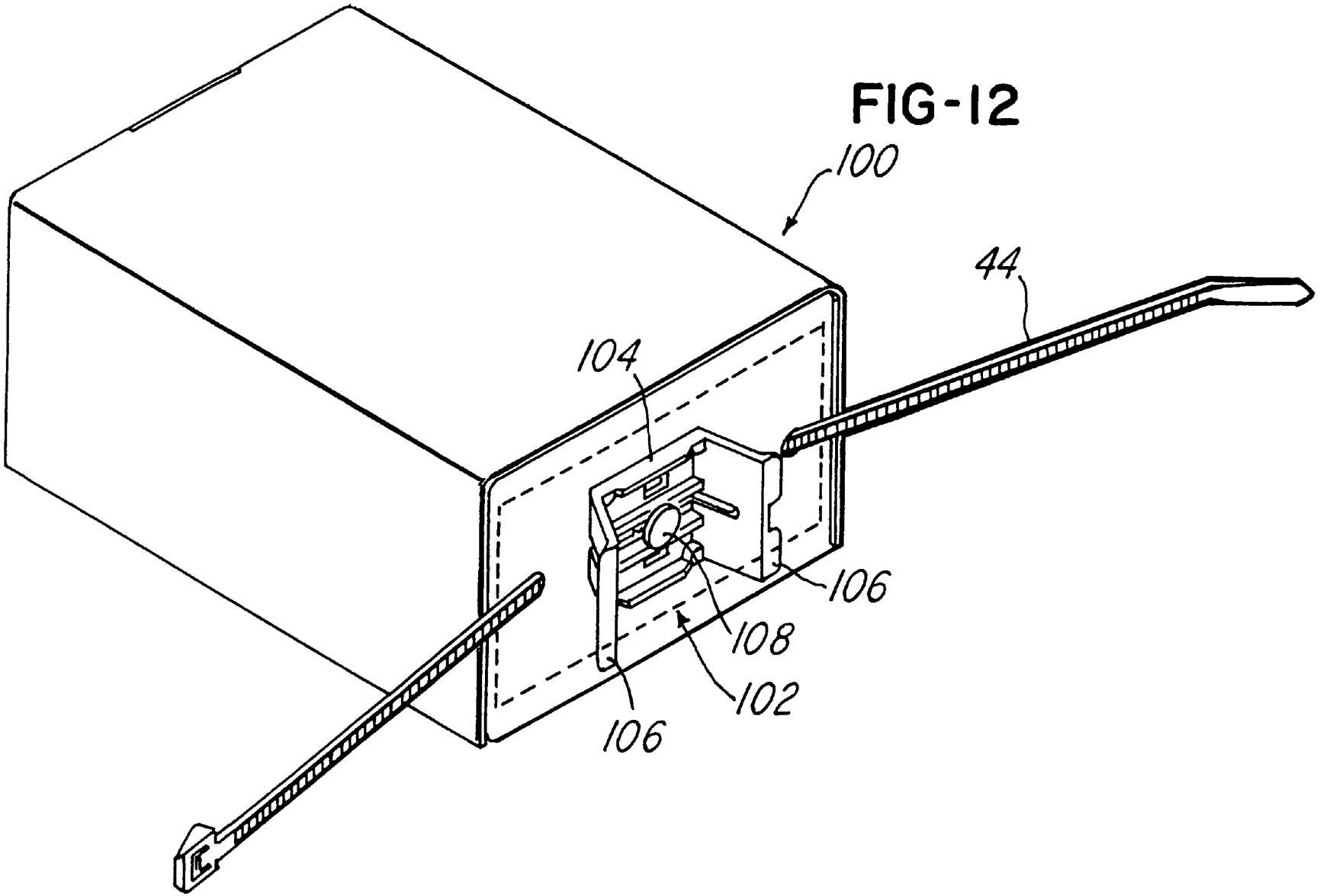
FIG. 12 is a perspective view similar to FIGS. 2 and 11 but showing a third embodiment of a coupon dispenser in accordance with this invention.
Figure 13:
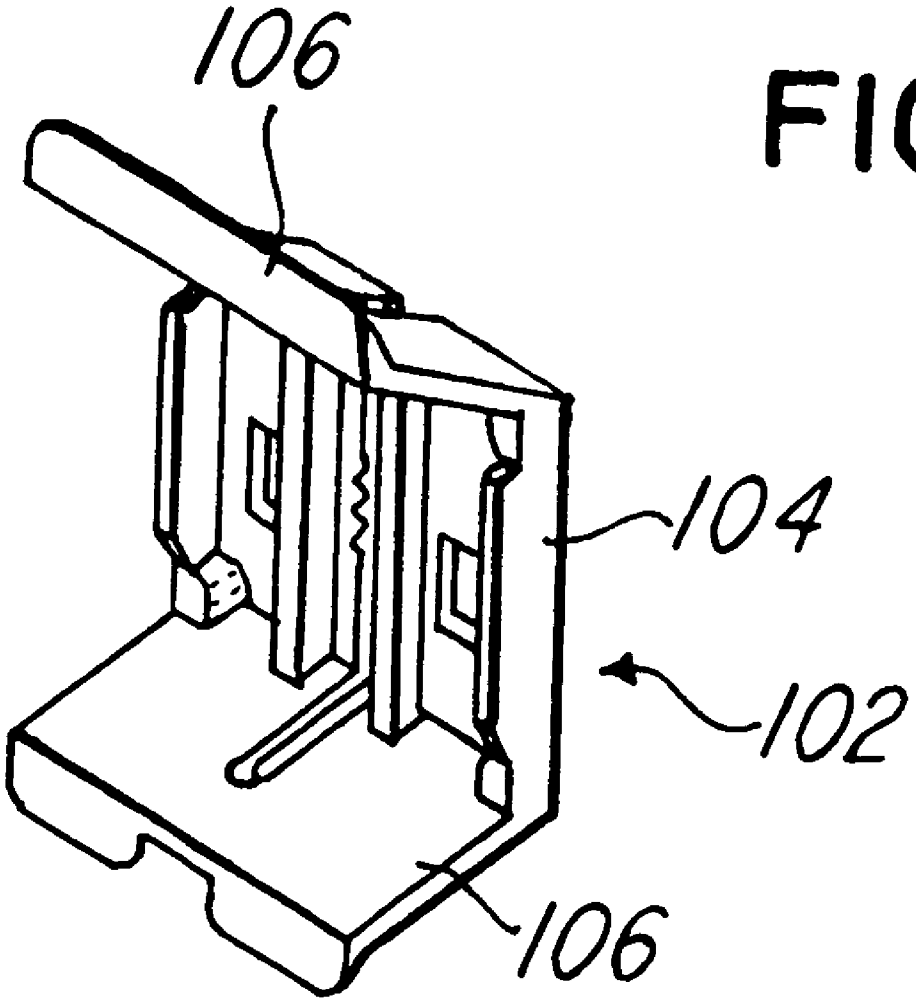
FIG. 13 is a perspective of a shelf clip used in the embodiment of coupon dispenser illustrated in FIG. 12.

Turning now to FIGS. 12 and 13, another embodiment of a coupon dispenser, generally designated 100, in accordance with this invention is provided with a shelf clip 102. The shelf clip 102 preferably comprises a one-piece molded plastic body formed to include a base plate 104 from which a pair of mutually-spaced spring arms 106 extends. During assembly, the base plate 104 is attached flush with the bottom wall of the dispenser 100 by a rivet 108, or by equivalent means such as glue or a screw. As will be immediately apparent, the shelf clip 102 can be used for securing the dispenser 100 to a pricing channel, such as the pricing channel 69 shown in FIG. 7. As will also be apparent, the shelf clip 102 may be used in addition to the cable tie 44, but could be used in lieu of the cable tie 44, in which event the cable tie 44 could be omitted or removed. If the cable tie 44 is used, it can be used in the fashion illustrated in FIG. 7.

In use, a coupon dispenser in accordance with this invention supplied with POST-IT sheets printed as manufacturer's coupons is supplied to a retailer who attaches the box to a rack, shelf, a display card, or other suitable support and optionally cuts off the excess tail end of the cable tie. Customers can remove the coupons one-at-a-time and affix them by their adhesive backing to the product for which the coupon is redeemable. The check-out cashier can simply remove the coupon from the product, having immediately determined the customer has, in fact, purchased the product for which the coupon is intended. When the dispenser box is empty, the retailer can remove it by simply cutting the cable tie and dispose of the box and the attached cable tie.

Figure 15:
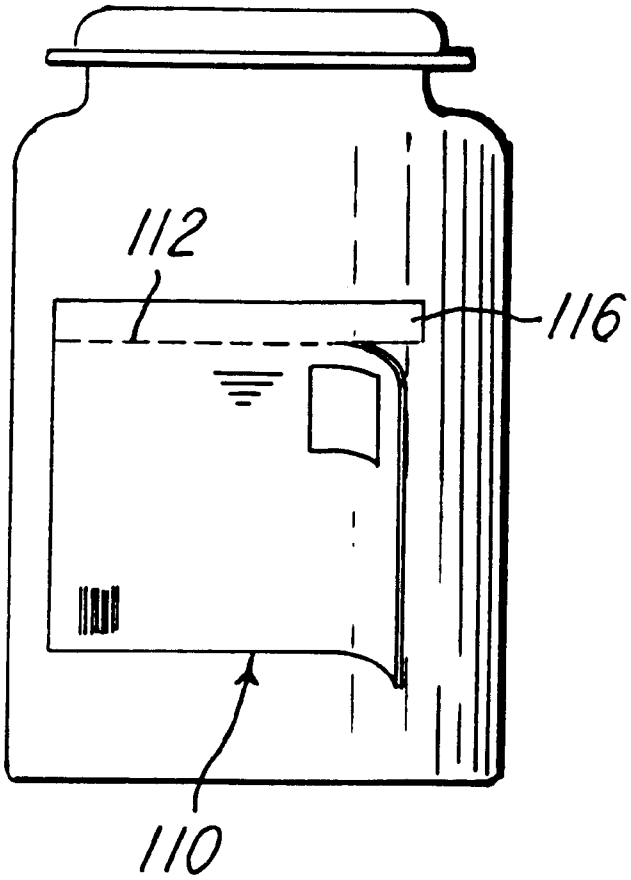
FIG. 15 is an elevational of a container to which the coupon of FIG. 14 is attached.
Figure 14:
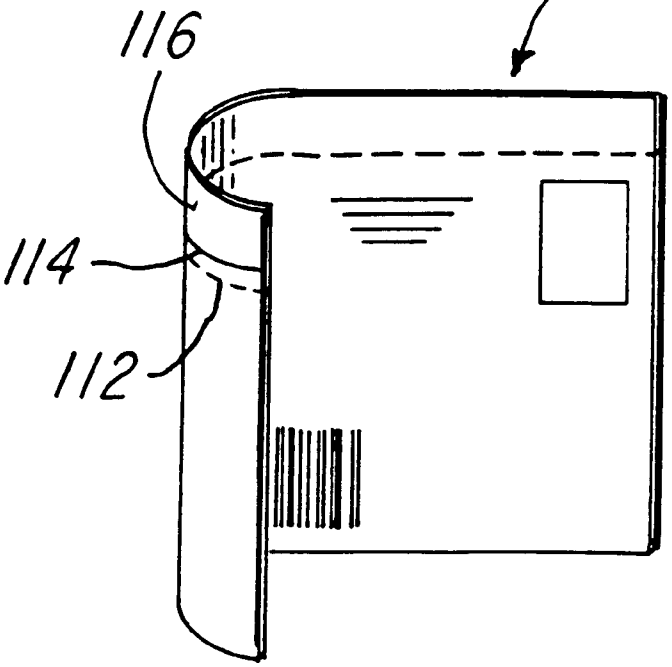
FIG. 14 is a perspective view of a modified coupon which may form part of a coupon dispenser of this invention.

In the embodiment shown in FIGS. 14 and 15, the coupons, designated 110, which are stacked in a pad (not shown) and housed in a dispenser box such as those described above, each have a tear line 112 adjacent the inner margin 114 of their adhesive strip 116. In use, the customer preferably adheres the adhesively coated portion of the coupon to the product to which the coupon applies. At the check-out counter, the cashier tears away the remainder of the label along the tear line, as indicated in FIG. 15. The torn-away portion is used by the retailer to redeem the coupon. The tear line may be formed by scoring, perforating, chemically treating the paper, or by otherwise weakening a thin strip of the paper. The embodiment of FIGS. 14 and 15 has the advantages discussed on the coupon dispensers described above in relation to FIGS. 1 though 13 plus the torn-away portions of the coupons which have no adhesive coating will be easier for the check-out cashier and others to accumulate and handle. Also, the face of a coupon opposite its adhesively coated portion may have advertising matter which the customer would take, because adhered to the purchased product, when leaving the retail store.

Although the presently preferred embodiments of this invention have been described, it will be understood that within the purview of the invention various changes may be made within the scope of the following claims.

Having thus described our invention, we claim:

1. A coupon dispenser comprising:

a dispenser box having an opening at its upper end;

a stack of sheets within said dispenser box, at least some of which are printed as coupons, each of said sheets having an adhesive along one margin and said sheets in said stack being arranged in accordion fashion so that the top one of said sheets can be pulled outwardly through said opening and removed from said stack while the adhesive thereon pulls the next sheet in the stack partly through said opening; and a cable tie connected to and extending from said box for connecting said box to a wire rack, shelving, display card or other support surface.

2. The dispenser of claim 1 further comprising a blinking LED extending through an opening in said box.

3. The dispenser of claim 1 wherein said dispenser box has a bottom wall, a pair of apertures extending through said bottom wall, and wherein said cable tie extends through said pair of apertures so that its ends are outside said box and an intermediate portion thereof is within said box.

4. The dispenser of claim 3 further comprising a blinking LED extending through an opening in said box.

5. The dispenser box of claim 3 wherein a stiffening plate is adhered to the inner surface of said bottom wall, said stiffening plate having a pair of apertures aligned with said apertures in said bottom wall and wherein said cable tie extends through both pairs of apertures.

6. The dispenser box of claim 3 wherein a paper tab is connected to said cable tie for preventing said cable tie from accidentally sliding out of engagement with said box.

7. The dispenser of claim 1 wherein said dispenser box has a bottom wall, wherein a stiffening plate is adhered to the inner surface of said bottom wall, and wherein said cable tie extends through said bottom wall and said stiffening plate.

8. A dispenser for message-carrying sheets, comprising:

a container having an opening at its upper end;

a stack of sheets within said container, at least some of which are printed with a message, each of said sheets having an adhesive along one margin and said sheets in said stack being arranged in accordion fashion so that the top one of said sheets can be pulled outwardly through said opening and removed from said stack while the adhesive thereon pulls the next sheet in the stack partly through said opening; and a fastener connected to and extending from said container for connecting said container to a wire rack, shelving, display card or other support.

9. The dispenser of claim 8 wherein each of said sheets printed with a message comprise a coupon.

10. The dispenser of claim 8 further comprising an attention-attracting signal emitter.

11. The dispenser of claim 10 wherein said emitter emits a repeating signal.

12. The dispenser of claim 11 wherein said emitter comprises a blinking LED extending through an opening in said container.

13. A dispenser for message-carrying sheets, comprising:

a container having an opening at its upper end;

a stack of sheets within said container, at least some of which are printed with a message, each of said sheets having an adhesive along one margin and said sheets in said stack being arranged in accordion fashion so that the top one of said sheets can be pulled outwardly through said opening and removed from said stack while the adhesive thereon pulls the next sheet in the stack partly through said opening; and a fastener extending from said container for connection to a wire rack, shelving, display card or other support and comprising a clip connected to said container.

14. A dispenser for message-carrying sheets, comprising:

a container having an opening at its upper end;

a stack of sheets within said container, at least some of which are printed with a message, each of said sheets having an adhesive along one margin and said sheets in said stack being arranged in accordion fashion so that the top one of said sheets can be pulled outwardly through said opening and removed from said stack while the adhesive thereon pulls the next sheet in the stack partly through said opening; and a fastener extending from said container for connection to a wire rack, shelving, display card or other support and comprising a strap engaged with said container.

15. The dispenser of claim 14 wherein said strap comprises a cable tie.

16. The dispenser of claim 15 wherein said container has a bottom wall, a pair of apertures extending through said bottom wall, and wherein said cable tie extends through said pair of apertures so that its ends are outside said container and an intermediate portion thereof is within said container.

17. The dispenser of claim 16 wherein a stiffening plate is disposed against the inner surface of said bottom wall, said stiffening plate having a pair of apertures aligned with said apertures in said bottom wall, and wherein said cable tie extends through both pairs of apertures.

18. The dispenser of claim 16 wherein a paper tab is connected to said cable tie for preventing said cable tie from accidentally sliding out of engagement with said container.

19. A dispenser for message-carrying sheets, comprising:

a container having an opening at its upper end;

a stack of sheets within said container, at least some of which are printed with a message, each of said sheets having an adhesive along one margin and a narrow weakened strip extending thereacross inwardly of the adhesive margin thereof, and said sheets in said stack being arranged in accordion fashion so that the top one of said sheets can be pulled outwardly through said opening and removed from said stack while the adhesive thereon pulls the next sheet in the stack partly through said opening; and a fastener extending from said container for connection to a wire rack, shelving, display card or other support.

20. The dispenser of claim 19 wherein said weakened strip comprises a strip of perforations.

21. The dispenser of claim 19 wherein, for each of said sheets, said sheet has front and rear faces and is divided into first and second portions by said weakened strip, wherein said adhesive is disposed on the rear face of the first portion thereof, and wherein the front face of the second portion thereof is printed with said message.

22. The dispenser of claim 21 wherein, for each of said sheets, the front face of the first portion thereof is also printed with a message.

23. A coupon dispenser, comprising:

a container having an opening at its upper end; and a stack of sheets within said container, at least some of which are printed as coupons, each of said sheets having an adhesive along one margin and a narrow weakened strip extending thereacross inwardly of the adhesive margin thereof, and said sheets in said stack being arranged in accordion fashion so that the top one of said sheets can be pulled outwardly through said opening and removed from said stack while the adhesive thereon pulls the next sheet in the stack partly through said opening.

24. The dispenser of claim 23 wherein said weakened strip comprises a strip of perforations.

25. The dispenser of claim 23 wherein, for each of said sheets, said sheet has front and rear faces and is divided into first and second portions by said weakened strip, wherein said adhesive is disposed on the rear face of the first portion thereof, and wherein the front face of the second portion thereof is printed as a coupon.

26. The dispenser of claim 25 wherein, for each of said sheets, the front face of the first portion thereof is printed with advertising.

27. A coupon dispenser for use in a retail store, said dispenser comprising:

a dispenser box having an opening at its upper end, a bottom wall and a pair of apertures extending through said bottom wall;

a stack of sheets within said dispenser box, at least some of which are printed as retail store coupons, each of said sheets having a repositionable adhesive along one margin and said sheets in said stack being arranged in accordion fashion so that the top one of said sheets can be pulled outwardly through said opening and removed from said stack while the adhesive thereon pulls the next sheet in the stack partly through said opening; and a cable tie engaged with said box for connecting said box to a wire rack, shelving, display card or other support surface, said cable tie extending through said pair of apertures so that its ends are outside said box and an intermediate portion thereof is within said box.

28. The dispenser of claim 27 further comprising a blinking LED extending through an opening in said box.

29. The dispenser box of claim 27 wherein a stiffening plate is adhered to the inner surface of said bottom wall, said stiffening plate having a pair of apertures aligned with said apertures in said bottom wall and wherein said cable tie extends through both pairs of apertures.

30. The dispenser box of claim 27 wherein a paper tab is connected to said cable tie for preventing said cable tie from accidentally sliding out of engagement with said box.

31. A coupon dispenser comprising:

a dispenser box having a top wall and a bottom wall, said top wall having an opening;

a stack of sheets within said dispenser box biased away from said bottom wall toward said top wall, at least some of said sheets being printed as coupons;

said opening in said top wall permitting removal of said sheets from said box; and a fastener connected to and extending from said box for connecting said box to a support; said stack of sheets being constructed and arranged so that a margin of the uppermost one of said sheets in said box is exposed through said opening for removal thereof and so that, a margin of the next lower sheet in said stack becomes exposed through said opening in response to the removal of the uppermost one of said sheets.

32. The coupon dispenser of claim 31 wherein said stack of sheets is constructed and arranged so that the removal of the uppermost one of said sheets causes the next lower sheet to be pulled partly through said opening.

33. The coupon dispenser of claim 31 wherein said fastener comprises a cable tie connected to and extending from said box.

34. The coupon dispenser of claim 33 wherein said cable tie is connected to and extends from said bottom wall of said box.

35. The coupon dispenser of claim 31 wherein said fastener comprises a shelf clip connected to and extending from said box.

36. The coupon dispenser of claim 35 wherein said shelf clip is connected to and extends from said bottom wall of said box.

37. The coupon dispenser of claim 31 wherein said stack of sheets is biased toward said upper wall by a spring confined within said box between said bottom wall and said stack of sheets.

38. The coupon dispenser of claim 32 wherein said spring comprises a coil spring.

39. The coupon dispenser of claim 31 wherein said bottom wall of said box has a pair of apertures for connection of said fastener to said box.

40. The coupon dispenser of claim 39 wherein a stiffening plate is adhered to the inner surface of said bottom wall, said stiffening plate having a pair of apertures aligned with said apertures in said bottom wall.

* * * * *

UNITED STATES PATENT AND TRADEMARK OFFICE

CERTIFICATE OF CORRECTION

PATENT : 5,944,219

DATED : August 31, 1999

INVENTOR(S) : Michael J. Emoff et al.

It is certified that error appears in the above-identified patent and that said Letters Patent is hereby corrected as shown below:

Column 10, line 18 (claim 38, line 1), change "32" to --37--.

Signed and Sealed this

Fourteenth Day of March, 2000

*Attest:*

Q. TODD DICKINSON

*Attesting Officer*

*Commissioner of Patents and Trademarks*